US010869135B2

(12) United States Patent
Tang et al.

(10) Patent No.: US 10,869,135 B2
(45) Date of Patent: Dec. 15, 2020

(54) SPEAKER

(71) Applicant: AAC Acoustic Technologies (Shenzhen) Co., Ltd., Shenzhen (CN)

(72) Inventors: Yun Tang, Shenzhen (CN); Lubin Mao, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 16/524,210

(22) Filed: Jul. 29, 2019

(65) Prior Publication Data

US 2020/0045463 A1 Feb. 6, 2020

(30) Foreign Application Priority Data

Aug. 3, 2018 (CN) ..... 2018 2 1255773 U

(51) Int. Cl.

| | |
|---|---|
| ***H04R 9/06*** | (2006.01) |
| ***H04R 9/02*** | (2006.01) |
| ***H04R 9/04*** | (2006.01) |
| ***H04R 1/02*** | (2006.01) |

(52) U.S. Cl.

CPC ..... *H04R 9/06* (2013.01); *H04R 1/02* (2013.01); *H04R 9/025* (2013.01); *H04R 9/04* (2013.01); *H04R 2307/027* (2013.01); *H04R 2400/11* (2013.01); *H04R 2499/11* (2013.01)

(58) Field of Classification Search

CPC . H04R 9/06; H04R 1/02; H04R 9/025; H04R 9/04; H04R 2307/027; H04R 2400/11; H04R 2499/11

USPC ..... 381/418

See application file for complete search history.

(56) References Cited

U.S. PATENT DOCUMENTS

| | | | | |
|---|---|---|---|---|
| 2005/0135651 | A1* | 6/2005 | Hakansson | H04R 11/02 381/396 |
| 2007/0071271 | A1* | 3/2007 | Ushikoshi | H04R 9/06 381/396 |
| 2013/0272563 | A1* | 10/2013 | Boyd | H04R 1/00 381/406 |
| 2015/0117699 | A1* | 4/2015 | Cai | H04R 9/025 381/412 |
| 2016/0225362 | A1* | 8/2016 | Xu | H04R 9/025 |
| 2017/0085992 | A1* | 3/2017 | Vitt | H04R 1/06 |
| 2017/0347199 | A1* | 11/2017 | Mao | H04R 31/006 |

FOREIGN PATENT DOCUMENTS

| | | | | |
|---|---|---|---|---|
| CN | 20513038 | * | 5/2016 | H04R 9/06 |

* cited by examiner

*Primary Examiner* — Sean H Nguyen

(74) *Attorney, Agent, or Firm* — W&G Law Group LLP

(57) ABSTRACT

The present disclosure provides a speaker which includes a frame, and a vibration system and a magnetic circuit system that are accommodated in the frame, where the magnetic circuit system is configured to drive the vibration system to vibrate and produce sound. The vibration system includes a diaphragm for vibrating and producing sound and a voice coil for driving the diaphragm to vibrate, and the magnetic circuit system includes a yoke fixedly connected to one end of the frame away from the diaphragm and a magnet assembled on the yoke. The vibration system further includes an iron core for driving the diaphragm to vibrate, and the voice coil is wound around the iron core. Compared with a related technology, the speaker provided in the present disclosure has a better acoustic effect.

6 Claims, 3 Drawing Sheets

A–A

SPEAKER

TECHNICAL FIELD

The present disclosure relates to acoustoelectric conversion technology, and in particular, to a speaker applied to a portable electronic product.

BACKGROUND

With an advent of a mobile Internet era, the number of smart mobile devices is increasingly rising. Among a large quantity of mobile devices, mobile phones are undoubtedly the most common and portable mobile terminal devices. Currently, functions of the mobile phones are extremely diverse, and one of the functions is a high-quality music function. Therefore, a large number of speakers for playing sounds are widely applied to the present smart mobile devices.

A speaker in a related technology includes a frame, and a magnetic circuit system and a vibration system that are accommodated in the frame, where the magnetic circuit system is configured to drive the vibration system to vibrate and produce sound. The magnetic circuit system includes a magnetic steel, and the vibration system includes a diaphragm for vibrating and producing sound and a voice coil connected to the diaphragm, where the magnetic steel is disposed inside the voice coil. A current is introduced to the voice coil, so that a Lorentz force is generated between the voice coil and the magnetic steel to drive the diaphragm to vibrate and produce sound.

However, the speaker in the related technology blocks air when the diaphragm vibrates as the magnetic steel is disposed inside the voice coil. Consequently, the air does not circulate, and aerodynamic noise may be easily generated. In addition, as only a current is introduced to the voice coil to generate the Lorentz force between the voice coil and the magnetic steel to drive the diaphragm, consequently, this driving manner has an insufficient driving force, and the speaker cannot obtain a high sound pressure level.

Therefore, it is necessary to provide a new speaker to resolve the foregoing problem.

BRIEF DESCRIPTION OF THE DRAWINGS

To describe technical solutions in embodiments of the present disclosure more clearly, the following briefly introduces accompanying drawings required for describing the embodiments. Apparently, the accompanying drawings in the following description show merely some embodiments of the present disclosure, and a person of ordinary skill in the art may still derive other drawings from these accompanying drawings without creative efforts.

DETAILED DESCRIPTION

The following clearly and completely describes technical solutions in embodiments of the present disclosure with reference to accompanying drawings in the embodiments of the present disclosure. Apparently, the described embodiments are merely some embodiments rather than all the embodiments of the present disclosure. All other embodiments obtained by a person of ordinary skills in the art based on the embodiments of the present disclosure without creative efforts shall fall within the protection scope of the present disclosure.

Figure 1:
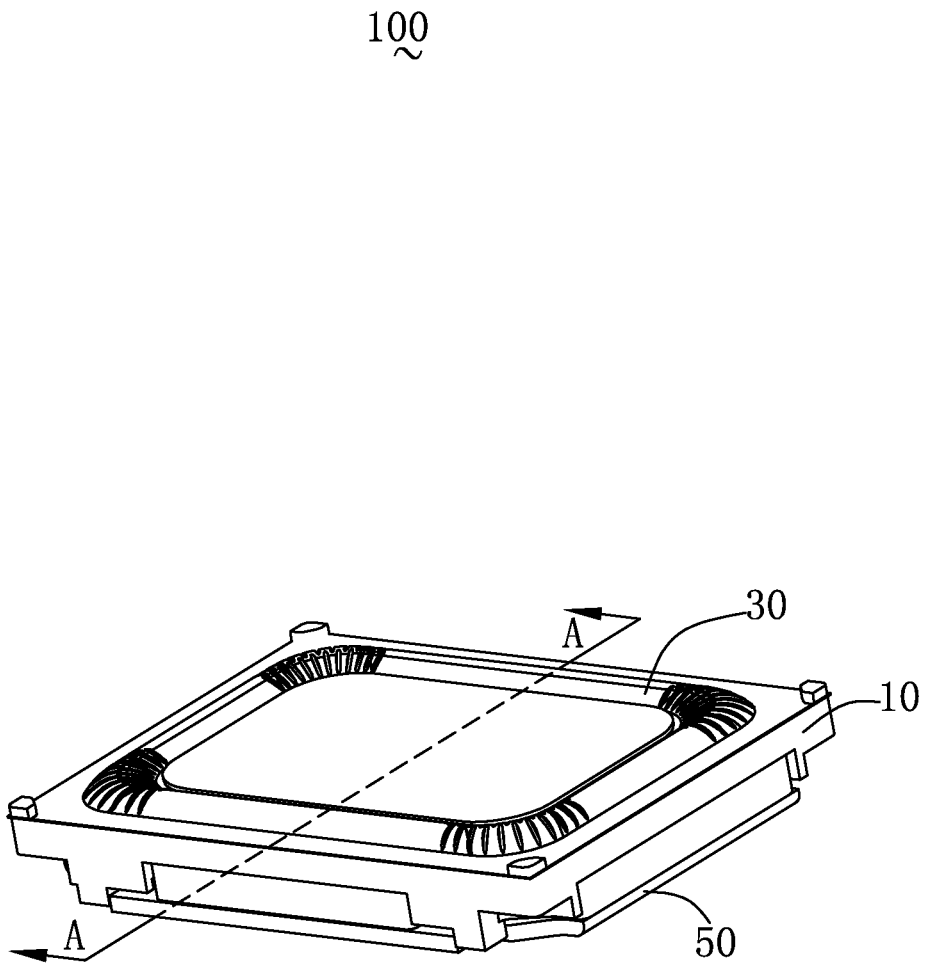
FIG. 1 is a schematic three-dimensional structural diagram of a speaker according to the present disclosure.

Refer to FIG. 1, the present disclosure provides a speaker 100 which includes a frame 10, and a vibration system 30 and a magnetic circuit system 50 that are fixed to the frame 10. The magnetic circuit system 50 is configured to drive the vibration system 30 to vibrate and produce sound.

The frame 10 is in a rectangular ring shape.

Figure 2:
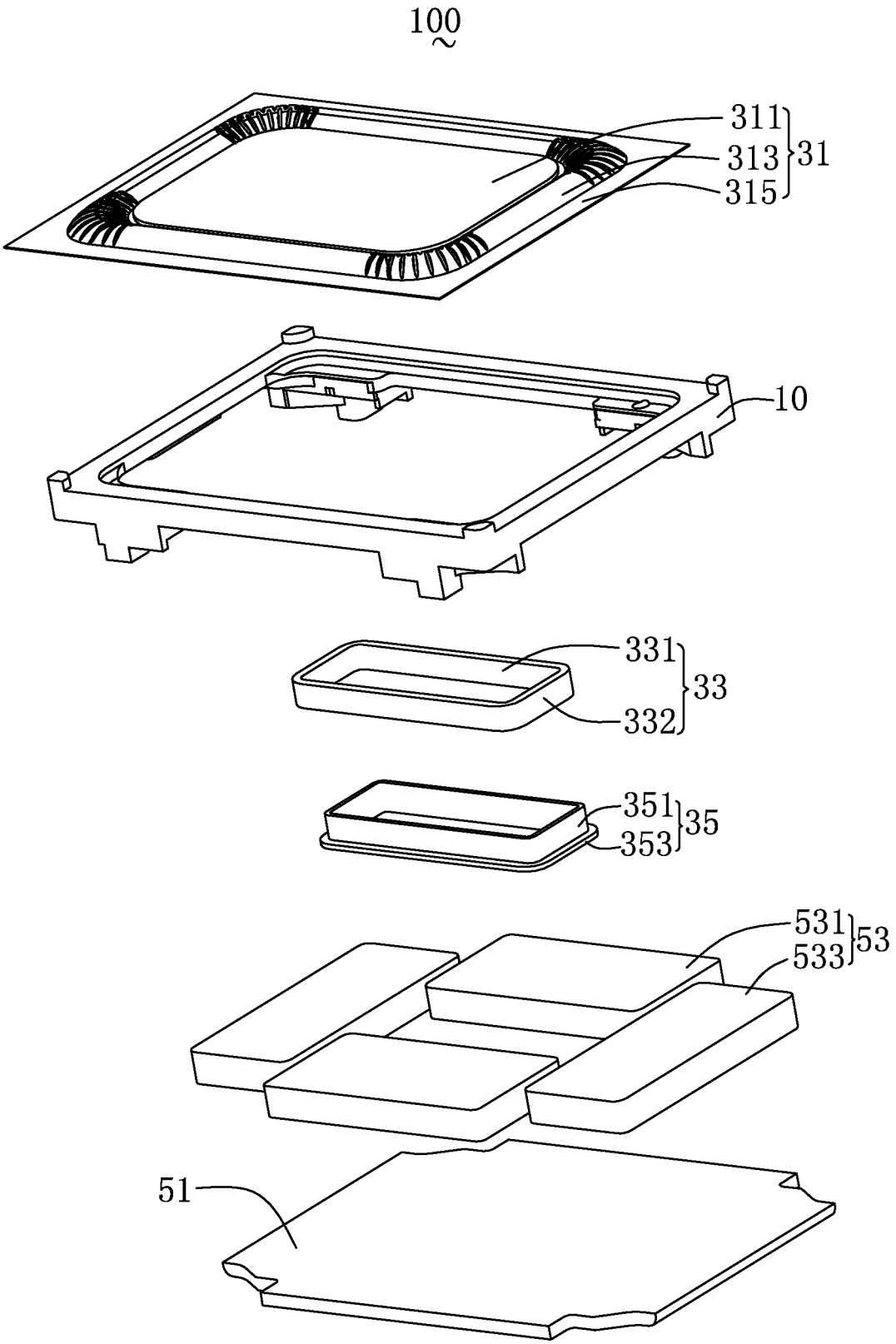
FIG. 2 is a schematic exploded structural diagram of the speaker according to the present disclosure.
Figure 3:
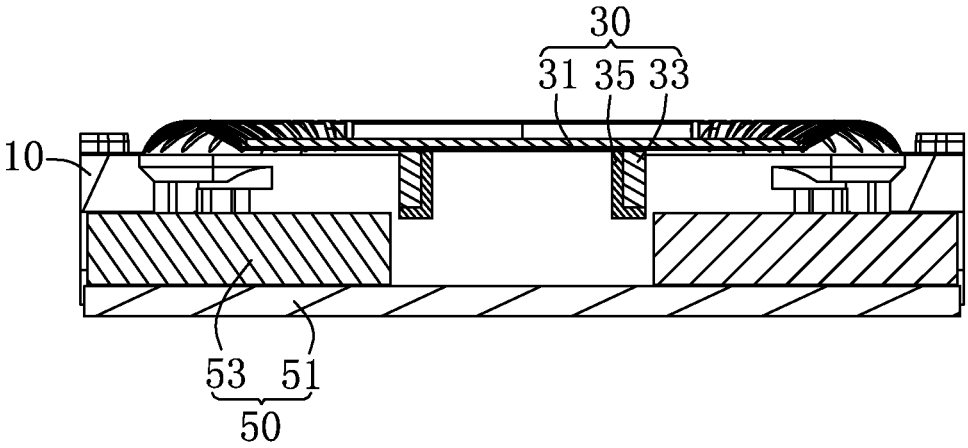
FIG. 3 is a sectional view along an A-A line shown in FIG. 1.

Refer to FIG. 2 and FIG. 3, the vibration system 30 includes a diaphragm 31 fixed to one end of the frame 10, and a voice coil 33 and an iron core 35 that are connected to the diaphragm 31 and that are configured to drive the diaphragm 31 to vibrate and produce sound.

The diaphragm 31 includes a dome portion 311 located in the middle, a folded ring portion 313 extending from an outer edge of the dome portion 311, and a fixing portion 315 extending from an outer edge of the folded ring portion 313, and the fixing portion 315 is fixed on the frame 10.

The voice coil 33 and the iron core 35 are fixedly connected to a lower surface of the diaphragm 31. Specifically, the voice coil 33 and the iron core 35 are fixedly connected to a lower surface of the folded ring portion 313.

The voice coil 33 and the iron core 35 are both in a rectangular ring shape, and junctions of sides of the voice coil 33 and the iron core 35 are all in an arc transitional connection.

The voice coil 33 is wound around the iron core 35.

The voice coil 33 includes two long shaft sides 331 that are disposed opposite to each other and two short shaft sides 333 that are respectively connected between the two long shaft sides 331.

After a current is introduced to the voice coil 33, one end of the iron core 35 away from the diaphragm 31 forms a magnetic pole which interacts with the magnetic circuit system 50 to generate a driving force.

The iron core 35 includes a body portion 351 and an extended portion 353 formed by extending from an outer side of the body portion 351 to be away from a center of the body portion 351.

The extended portion 353 is disposed surrounding the body portion 351, and the extended portion 353 is located at one end of the body portion 351 away from the diaphragm 31. The voice coil 33 is wound around the body portion 351 and abuts against the extended portion 353. After a current is introduced to the voice coil 33, the extended portion 353 forms a magnetic pole which interacts with the magnetic circuit system 50 to generate a driving force.

In this embodiment, the iron core 35 is provided with the extended portion 353 abutting against the voice coil 33. Of course, in other embodiments, the iron core 35 may be provided with only the body portion 351 but not provided with the extended portion 353. The voice coil 33 and the iron core 35 are fixed only by winding the voice coil 33 around the body portion 351. That is, the iron core 35 may be a ring structure whose shape is consistent with the shape of the voice coil 33.

It should be noted that in this embodiment, the voice coil 33 may be a voice coil wire or a combination of a voice coil wire and a framework. When the voice coil 33 is a voice coil wire, the voice coil wire is disposed wound around the iron core 35. When the voice coil 33 is a combination of a voice coil wire and a framework, the voice coil wire is disposed wound around the framework, and the voice coil wire and the framework are disposed surrounding the iron core 35. It should be noted that in this embodiment, the voice coil 33 may be a voice coil wire or a combination of a voice coil wire and a framework.

In addition, it may be also understood that the voice coil 33 and the iron core 35 are connected to the diaphragm 31 in a manner that both an upper surface of the voice coil 33 and an upper surface of the iron core 35 are fixedly connected to the diaphragm 31 or only an upper surface of the voice coil 33 is fixedly connected to the diaphragm 31 but an upper surface of the iron core 35 is disposed separately from the diaphragm 31, or even only an upper surface of the iron core 35 is fixedly connected to the diaphragm 31 but an upper surface of the voice coil 33 is disposed separately from the diaphragm 31. In this embodiment, the upper surface of the voice coil 33 and the upper surface of the iron core 35 are both fixedly connected to the diaphragm 31, so that the voice coil 33 and the iron core 35 has better stability when driving the diaphragm 31 to vibrate.

The magnetic circuit system 50 includes a yoke 51 fixedly connected to one end of the frame 10 away from the diaphragm 31 and a magnetic steel 53 assembled on the yoke 51.

The magnetic steel 53 is disposed surrounding the voice coil 33, and the magnetic steel 53 is disposed separately from the voice coil 33.

Specifically, a polarity of a magnetic pole of a side of the magnetic steel 53 close to the diaphragm 31 is opposite to that of a magnetic pole of a side of the magnetic steel 53 away from the diaphragm 31.

The magnetic steel 53 includes two first magnetic steels 531 and two second magnetic steels 533, where the two first magnetic steels 531 are disposed separately from the two long shaft sides of the voice coil 33, and the two second magnetic steels 533 are disposed separately from the two short shaft sides of the voice coil 33. The two first magnetic steels 531 and the two second magnetic steels 533 form a magnetic gap, and the iron core 35 and the voice coil 33 are disposed in the magnetic gap.

When a current is introduced to the voice coil 33, magnetic induction lines of the magnetic steel 53 interact with the voice coil 33 to generate a Lorentz force, so that the voice coil 33 drives the diaphragm 31 to vibrate and produce sound. Specifically, the voice coil 33 magnetizes the iron core 35 when a current is introduced to the voice coil 33, so that the iron core 35 and the magnetic steel 53 attract or repel each other, thereby enabling the iron core 35 to drive the diaphragm 31 to vibrate and produce sound. The iron core 35 and the voice coil 33 are provided, so that the speaker 100 can generate two driving forces for driving the diaphragm 31 to vibrate, that is, the Lorentz force generated by interacting the magnetic steel 53 with the voice coil 33 when a current is introduced to the voice coil 33, and an electromagnetic force generated by interacting the magnetic steel 53 with the iron core 35 after a current is introduced to the voice coil 33 to magnetize the iron core 35. By superposing the Lorentz force and the electromagnetic force, a large driving force can be achieved, so that the speaker 100 obtains a higher sound pressure level.

It should be noted that a current introduced to the voice coil 33 is an alternating current, so that polarities at two ends (herein an upper end and a lower end shown in FIG. 2) of the iron core 35 constantly change to achieve attraction and repulsion with the magnetic steel 53, thereby driving the diaphragm 31 to vibrate and produce sound.

It may be understood that the voice coil 33 can be conductive by connecting a lead wire or a flexible circuit board to an external power supply.

Compared with the related technology, with respect to the speaker provided in the present disclosure, as the voice coil is wound on the iron core, a Lorentz force is generated between the voice coil and the magnetic circuit system to drive the diaphragm to vibrate once a current is introduced to the voice coil, and the iron core also becomes magnetic to generate an acting force along with the magnetic circuit system to drive the diaphragm to vibrate. The Lorentz force generated between the voice coil and the magnetic circuit system and the acting force generated between the iron core and the magnetic circuit system are superposed, to improve a driving force for driving the diaphragm to vibrate, so that the speaker can obtain a higher sound pressure level, thereby improving the acoustic effect of the speaker. In addition, the magnetic steel is disposed surrounding the voice coil, so that air inside the voice coil can circulate better, avoiding aerodynamic noise from being generated, to improve the acoustic effect of the speaker.

The foregoing descriptions are merely embodiments of the present disclosure. It should be noted herein that a person of ordinary skills in the art may made improvements without departing the creation idea of the present disclosure. However, these improvements fall within the protection scope of the present disclosure.

What is claimed is:

1. A speaker, comprising a frame, and a vibration system and a magnetic circuit system that are accommodated in the frame, wherein the magnetic circuit system is configured to drive the vibration system to vibrate and produce sound, the vibration system comprises a diaphragm for vibrating and producing sound and a voice coil for driving the diaphragm to vibrate, and the magnetic circuit system comprises a yoke fixedly connected to one end of the frame away from the diaphragm and a magnetic steel assembled on the yoke, wherein the vibration system further comprises an iron core for driving the diaphragm to vibrate, and the voice coil is wound around the iron core, the voice coil and the iron core are fixedly connected to a lower surface of the diaphragm, after a current is introduced to the voice coil, the iron core forms a magnetic pole interacting with the magnetic circuit system to generate a driving force, and the magnetic pole interacting with the magnetic circuit system to generate the driving force is located at one end of the iron core away from the diaphragm.

2. The speaker according to claim 1, wherein the diaphragm comprises a folded ring portion and a dome portion disposed in the middle of the folded ring portion, and the voice coil and the iron core are fixedly connected to a lower surface of the folded ring portion.

3. The speaker according to claim 1, wherein the voice coil and the iron core are both in a rectangular ring shape, and the voice coil comprises two long shaft sides that are disposed opposite to each other and two short shaft sides respectively connected between the two long shaft sides.

4. The speaker according to claim 1, wherein the iron core comprises a body portion and an extended portion formed by extending from an outer side of the body portion to be away from a center of the body portion, the extended portion is located at one end of the body portion away from the diaphragm, and after a current is introduced to the voice coil, the extended portion forms a magnetic pole interacting with the magnetic circuit system to generate a driving force.

5. The speaker according to claim 4, wherein the voice coil is wound around the body portion and abuts against the extended portion.

6. The speaker according to claim 1, wherein the magnetic steel comprises two first magnetic steels and two second magnetic steels, the two first magnets are disposed separately from two long shaft sides of the voice coil, the two second magnets are disposed separately from two short shaft sides of the voice coil, the two first magnetic steels and the two second magnetic steels form a magnetic gap, and the iron core and the voice coil are disposed in the magnetic gap.

* * * * *